US005435159A

United States Patent [19]

Ramsauer

[11] Patent Number: 5,435,159

[45] Date of Patent: Jul. 25, 1995

[54] LOCK HOUSING WITH FLANGE FOR FITTING IN AN APERTURE IN A THIN WALL LIKE A SHEET METAL CUPBOARD DOOR OR SHEET METAL CASING COVER

[76] Inventor: Dieter Ramsauer, Am Neuhauskothen 20, D-5620 Velbert 11, Germany

[21] Appl. No.: 252,983

[22] Filed: Jun. 2, 1994

Related U.S. Application Data

[63] Continuation of Ser. No. 847,061, filed as PCT/EP90/01460, Aug. 31, 1990, abandoned.

[30] Foreign Application Priority Data

Oct. 3, 1989 [DE] Germany ..... 39 32 939.9
Oct. 3, 1989 [DE] Germany ..... 89 11 765 U

[51] Int. Cl.[6] ..... E05B 9/04

[52] U.S. Cl. ..... 70/370; 70/451; 70/466

[58] Field of Search ..... 70/370, 451, DIG. 38, 70/371, 373, 422, 466; 411/913, 508, 510, 552

[56] References Cited

U.S. PATENT DOCUMENTS

| | | | |
|---|---|---|---|
| Re. 22,544 | 9/1944 | Tinnerman | 411/913 |
| 1,561,254 | 11/1925 | Ledin | 70/370 |
| 2,093,038 | 9/1937 | Douglas | 70/370 |
| 2,632,615 | 3/1959 | Churchill | 411/508 |
| 3,190,092 | 6/1965 | Patriquin | 70/370 |
| 3,535,673 | 10/1970 | Maltais et al. . | |
| 4,080,522 | 3/1978 | Schimmels | 411/510 |
| 4,128,923 | 12/1978 | Bisbing | 411/552 |
| 4,139,998 | 2/1979 | Jeavons et al. | 70/370 |
| 4,381,656 | 5/1983 | Hayakawa | 70/370 |

FOREIGN PATENT DOCUMENTS

| | | | |
|---|---|---|---|
| 0258491 | 11/1986 | European Pat. Off. . | |
| 4006706 | 9/1991 | Germany | 70/451 |
| 1518334 | 7/1978 | United Kingdom | 70/451 |

*Primary Examiner*—Peter M. Cuomo
*Assistant Examiner*—Darnell M. Boucher
*Attorney, Agent, or Firm*—McAulay Fisher Nissen Goldberg & Kiel

[57] ABSTRACT

A lock housing having a flange; a hollow body for receiving a lock, the body being connected to the flange at one end, having an external surface and being insertable in a hole in a wall; and a spring for mounting the housing in the hole, the spring occupying a range of positions between a compressed position and a non-compressed position, the compressed position occurring when the spring is substantially parallel to the external surface and the non-compressed position occurring when the spring is at rest, the spring occupying the compressed position during insertion of the hollow body into the hole and occupying a position other than the compressed position when fully inserted to bias the flange against the wall.

3 Claims, 12 Drawing Sheets

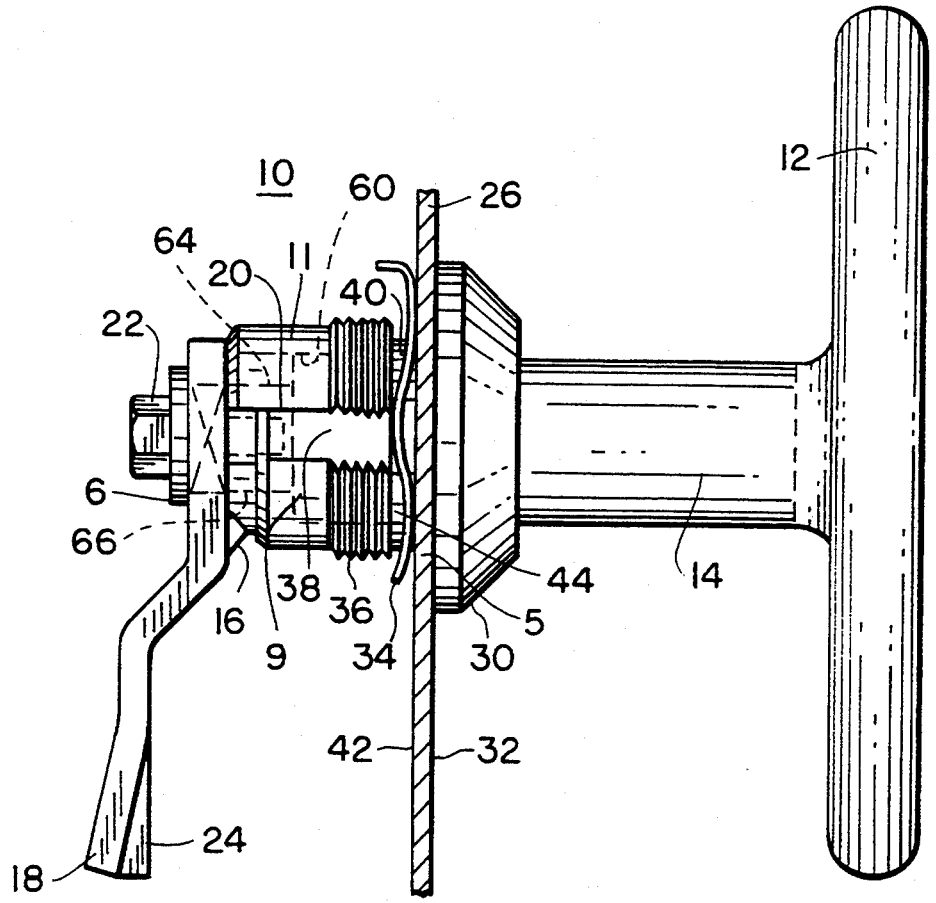
FIG.9
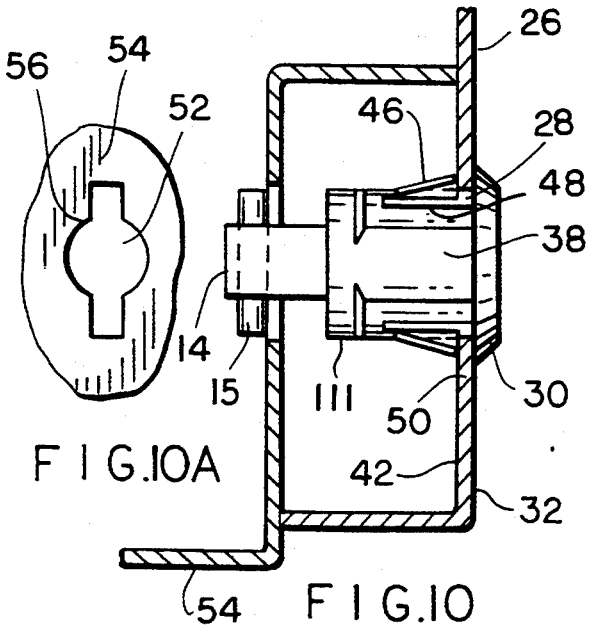
FIG.10A
FIG.10
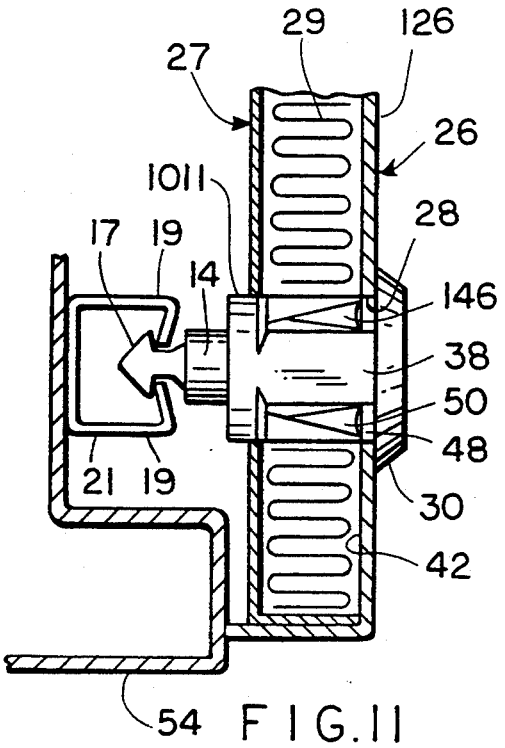
FIG.11

LOCK HOUSING WITH FLANGE FOR FITTING IN AN APERTURE IN A THIN WALL LIKE A SHEET METAL CUPBOARD DOOR OR SHEET METAL CASING COVER

This is a continuation of application Ser. No. 07/847,061, filed as PCT/EP90/01460, Aug. 31, 1990, now abandoned.

TECHNICAL FIELD

The invention is directed to a lock housing comprising a flange, center part and rear part for mounting in an aperture in a thin wall, such as a sheet metal cabinet door or sheet metal housing cover, wherein the housing is held by means of a spring or springs contacting the edge of the aperture or rear surface of the thin wall after inserting the rear end and center part through the aperture as far as the flange, and the spring or springs contacting the edge of the aperture or rear surface of the thin wall proceeds or proceed from the outer surface of the center part of the housing in proximity to the end of the housing or from the end of the housing of the lock and is or are rigidly connected axially with the housing.

The invention is also directed particularly to a lock housing as part of a lock, such as a sash lock, which can be mounted in an electrically conducting thin wall, such as a switch cabinet door. The lock housing or lock can be fastened in the aperture of the electrically conducting thin wall, such as a switch cabinet door of sheet steel or the like, by means of grounding and/or fastening springs. If necessary, an electrical connection can be produced between the electrically conducting wall and spring on the one hand and between the spring and lock housing or lock shaft (or other movable part of the lock, which part receives and supports the key) supported therein on the other hand.

BACKGROUND ART

A housing of this type is already known from EU 0 258 491 A1. Moreover, reference is made to EU 0 025 478 A1 and to EU 0 025 472 A1. Moreover, the present Applicant knows of a sash lock for a sheet metal cabinet door in which the screw holding the sash tongue also holds a spring which is bent in a U-shape and contacts the rear surface of the door leaf with the free end of its leg and, in so doing, secures the housing in the aperture. In a manner similar to that known from EU 0 258 491 A1, the latter arrangement can be mounted without a cumbersome screwing on of nuts or attachment of fastening springs in that the sash lock can be fastened by simply inserting the housing into the door lock aperture as far as the flange. In EU 0 025 478 A1, on the other hand, the fastening of the lock housing is only possible in that a fastening spring is inserted into a corresponding circumferential groove of the housing on the back of the wall after the insertion of the housing.

For the rest, such sash locks previously worked for the most part with screw-type fastening which requires that the fastening nut be placed on and then tightened from the rear after inserting the housing through the wall aperture. This has the disadvantage, as is the case with fastening by means of a plug-in spring, that it requires a special structural component part which is separate from the housing and which can also be lost. In addition, a blind fastening is not possible here in cases where the back of the wall is not easily accessible.

This disadvantage does not occur in a blind fastening according to the lock known to the Inventor, but the lock known to the Inventor has the disadvantage that the fastening spring transmits its pressure load to the support of the sash tongue and accordingly leads to unwanted high friction and hindrance of the locking process. An improvement is made this respect in EU 0 025 478 A1, in which the back of the wall likewise need not be accessible for mounting the lock housing, since the springs arranged at the housing contact behind the wall after the housing is inserted through the wall aperture and fix the housing so as to lock it. In addition, there is no loading of the sash axis in this case, since the fastening forces are transmitted directly to the lock housing.

However, the construction known from EU 0 258 491 A1 obviously requires an aperture other than the conventional aperture (round hole with two or four conventional flattened portions serving as protection against rotation). For example, FIG. 4 of EU 0 258 491 A1 shows an aperture with additional recesses 31 provided in the region of two flattened portions. The other embodiment forms of EU 0 258 491 A1 (see FIGS. 9, 13) also require such additional recesses which increase production costs and interfere with the compatibility of locks which are already commercially available. In the embodiment forms according to FIGS. 5 and 6, apertures departing from the round shape are obviously not required. But these embodiment forms are not directed to a lock housing, but rather to sleeves for receiving such housings. Accordingly, lateral apertures are required for holding the lock housing, which leads to sealing problems if the arrangement is to be used in a sheet metal cabinet or sheet metal housing to be sealed.

A lock with grounding and/or fastening springs in the form of a sash lock is already known from the European Patent Publication 0 025 472. A disadvantage in the latter consists in that in order to fasten the lock in the sheet metal wall a spring which is separate from the lock housing and is bent in a U-shaped manner as seen from above must be attached to the housing, which is provided with lateral grooves, from behind after inserting the lock through the sheet metal wall aperture from the front in order to effect the fastening process and the grounding process.

However, a blind mounting of such a lock is also desirable in this case. Also, the known lock is not sufficiently resistant to shaking in many cases, i.e. the inserted spring can be removed again from its inserted position during strong vibration stresses, thus releasing the lock.

DISCLOSURE OF THE INVENTION

The object of the invention is to improve the construction known from the prior art in such a way that the lock housing can be mounted simply by inserting and locking in the thin wall without requiring additional recesses in the aperture of the thin wall and without openings in the circumferential area of the housing. A sufficient grounding contact particularly between the handle or key of the lock and e.g. the sheet metal wall is also to be provided in addition, if necessary, when the lock housing comprises a nonconducting plastic such as polyamide, instead of metal.

The object is met, according to the invention, in that (for a circular, round aperture in the thin wall, which aperture is possibly provided with two or four chord-like narrowed portions offset by 180° or 90° relative to one another) in case the outer section of the housing is circular or comprises flattened portions corresponding to the section shape of the aperture, the surface of the housing is set back (possibly in the areas between the flattened portions, if such flattened portions are present) and accordingly forms axially aligned grooves at its outer surfaces, wherein the spring(s) proceeds (or proceed) from one side wall of these grooves, or alternatively in that when flattened portions are present the springs are arranged in the area of the flattened portions and the housing comprises a recessed or offset space in the area of two opposite flattened portions for a spring proceeding from the end of the housing.

In the first alternative, the spring can form a cross section along the groove, which cross section increases toward the front end of the housing. This cross section can have a triangular, semicircular or half-oval shape and can increase from a small value, starting from the rear end of the housing, to a maximum value at the free end face of the spring. The end of the spring contacting the door leaf when the housing is located in the work position can form a bend which faces outward. According to the other alternative of the main claim, the housing can comprise an offset space in the area of two opposite flattened portions for a spring proceeding from the end of the housing: this spring can be V-shaped in cross section and the tip of the V can face the offset space and be supported on the surface formed by the offset. The angle ($\alpha$) enclosed by the V-cross section decreases from 180° at the end of the fastening to 170°. . . 150°, preferably 165°, toward the free end. The springs can proceed from an end area of the housing which simultaneously comprises an annular groove or annular notch forming an end stop (for a stop boss proceeding from a sash).

The springs proceeding from the housing can be injection molded from plastic, particularly polyamide, so as to form one piece. However, the spring can also be a metal part which is rigidly connected axially with the housing, wherein the metal is preferably spring metal such as steel. The housing can likewise be die cast from a metal, e.g. die-cast zinc, or can also consist of plastic. This metal spring can be bent in a U-shaped or cup-shaped manner so that the spring grasps the rear end of the housing with the U-web or cup base, is axially supported at the rear end or in proximity to the rear end, and is supported with the U-leg ends or cup rims on the other side of the thin wall. The U-legs of the spring, which is U-shaped as seen from the side, are preferably arranged in the area of the flattened portions. On the other hand, the cup wall of the cup-shaped spring comprises four legs which are offset by 90° relative to one another, wherein the legs lie in the area of a flattened portion of the housing in each instance. The spring can be held by a projection or protuberance proceeding from the housing, or the spring is held by offset portions at the circumferential surface of the housing. Alternatively, the spring can be held by a spring part which reaches through the sheet metal wall aperture and comprises end hooks. But the spring can also be held by a disk placed on the end face of the housing. Offsets are provided in the housing wall for receiving spring parts which project forward in the rest state. Such a spring, which can be fastened at the lock, can be produced in that e.g. a sheet-steel blank of the spring is first formed accompanied by the simultaneous shaping of openings, eyes, edges and/or folds, in that the spring blank is then hardened and the spring is finally attached to the housing of the lock. After the latter process, the spring could be fastened at the housing by means of a part which can be securely connected with the housing or with a part which can be securely connected with parts (e.g. shaft, tongue) projecting from the housing. This fastening can be effected by gluing or by pressing tongue-and-groove devices on the parts to be fastened together. But the fastening can also be effected by means of flattening out housing projections guided through openings in the spring (possibly with the application of heat when using plastics).

If a grounding contact is to be achieved, the spring is constructed in such a way that at least one rough or sharp edge of the spring scrapes along in the interior of the wall aperture and/or at the edge between the interior of the wall aperture and the rear surface of the wall when the housing carrying the spring is inserted through the wall aperture and, after reaching the end position in which the flange contacts the front face of the wall, metallically blank parts of the spring press against the areas of the wall which have accordingly been scraped blank, the wall comprising e.g. sheet steel, and in that the spring communicates with the housing (if electrically conductive) and/or with an electrically conducting part supported in the housing which receives or carries the key or the like, such as a lock shaft or cylinder.

The spring is preferably bent (particularly bent in a U-shaped or cup-shaped manner) in such a way that it is axially supported at the rear end or in proximity to the rear end of the housing and grasps the rear end of the housing, as the case may be, with the U-web or the cup base and is supported by the ends of the spring in the same way as by the ends of the U-legs or the cup rim on the other side of the sheet metal wall, e.g. the door leaf or the like, and is moreover constructed in such a way that it produces the electrical connection between an electrically conducting movable part of the lock, such as the actuating shaft, and the U-web or cup base of the spring.

Additional subclaims teach constructions serving in particular to produce a particularly good grounding contact between the sheet metal wall and the spring without its fastening characteristics being negatively influenced thereby. It is particularly important that the spring should be constructed, if possible, in such a way that it exerts no particular load in the axial direction on the lock core, so that the actuation of the lock core is not unnecessarily impeded by axial pressure to be absorbed.

BRIEF DESCRIPTION OF THE INVENTION

The invention is explained in more detail in the following with the aid of embodiment examples shown in the figures:

FIG. 9 is a side view of a sash lock mounted in a door leaf in which the housing can be fastened by means of a U-shaped plug-in spring which is separate from the housing or by a fastening nut, as desired;

FIG. 10 is a side view of a so-called quarter-turn lock with cross-pin in which a housing shape similar to that in FIG. 1 is used;

FIG. 10A shows the aperture in the door frame required for the cross-pin;

FIG. 11 shows a quarter-turn lock according to another embodiment form in a view similar to FIG. 10, in which the housing has a shape similar to that of FIG. 6, wherein the embodiment forms of FIGS. 10 and 11 are particularly advantageous for the housing constructed according to the invention because of their central loading;

Figure 12:
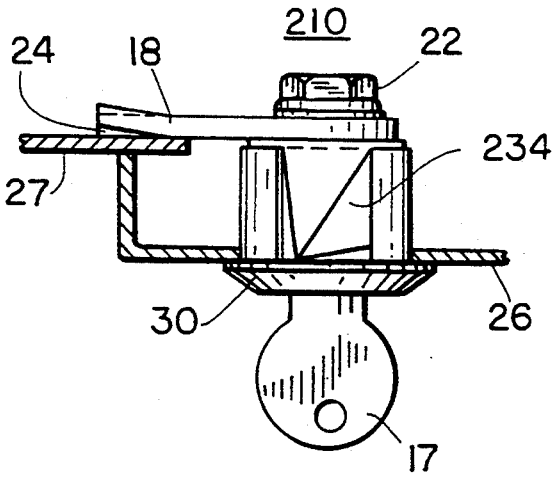
Figure 16:
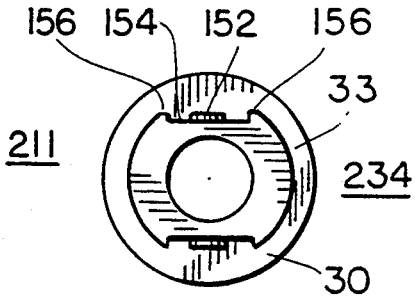
Figure 13:
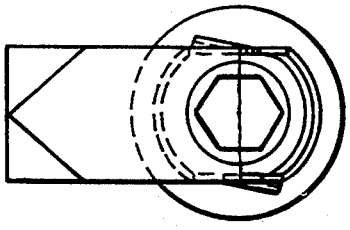
Figure 17:
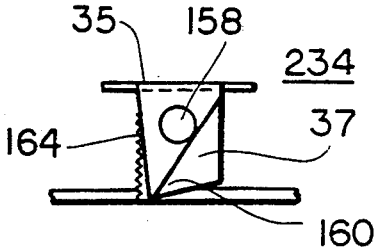
Figure 14:
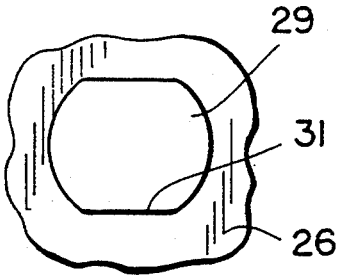
Figure 15:
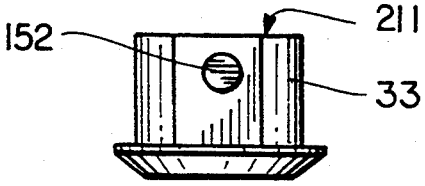
Figure 18:
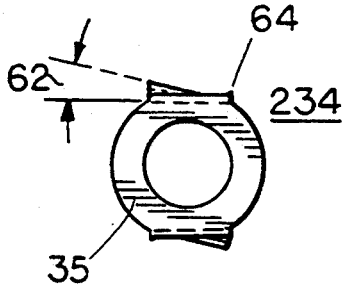
Figure 19:
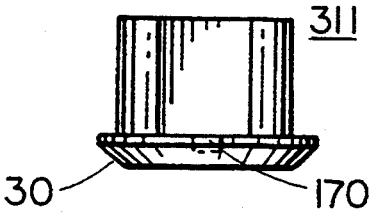
Figure 20:
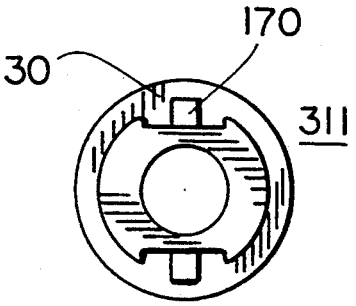
Figure 21:
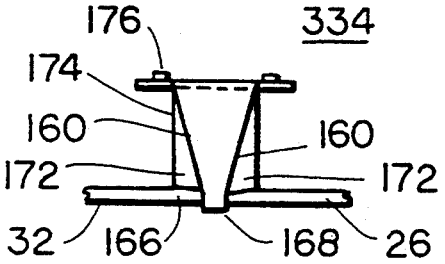
Figure 22:
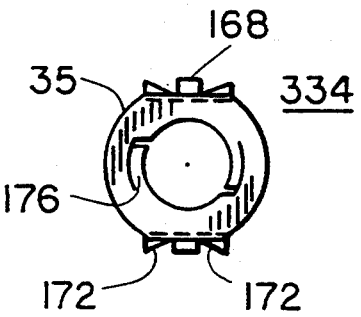
Figure 23:
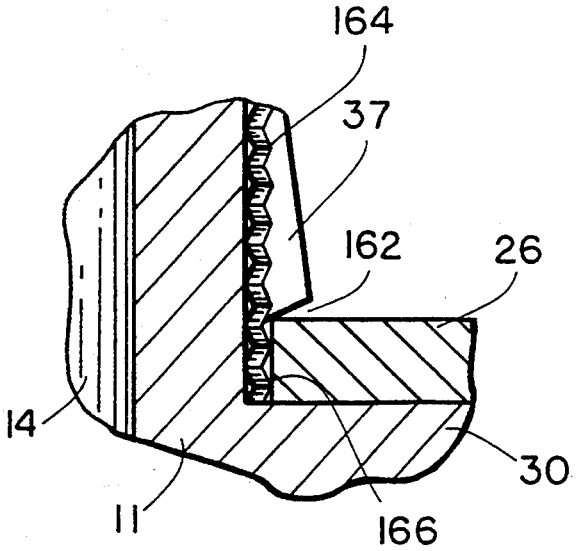
Figure 24:
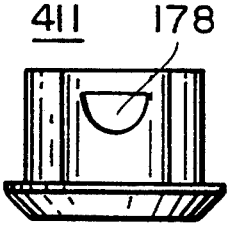
Figure 26:
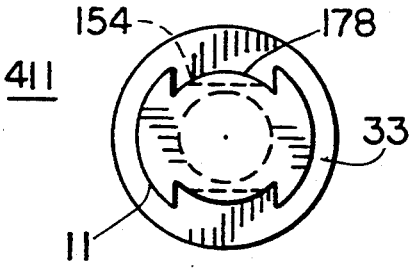
Figure 25:
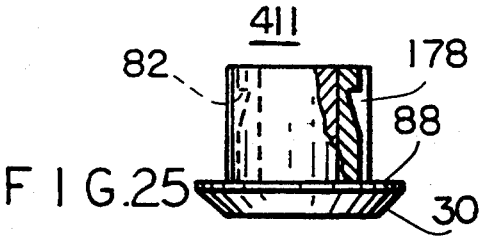
Figure 27:
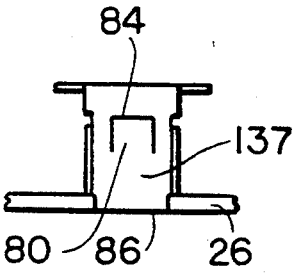
Figure 28:
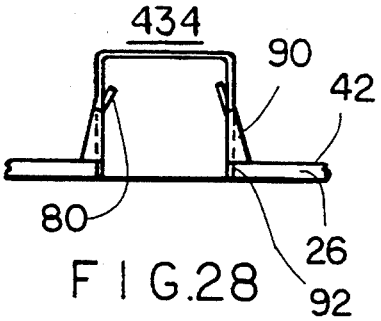
Figure 29:
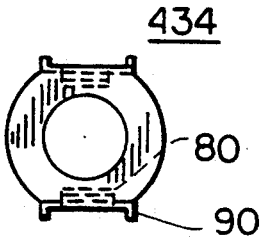
Figure 30:
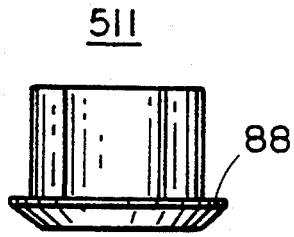
Figure 31:
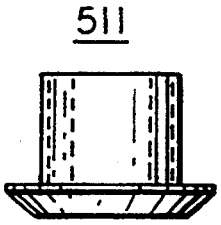
Figure 32:
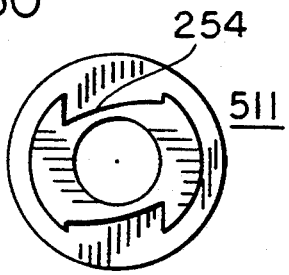
Figure 33:
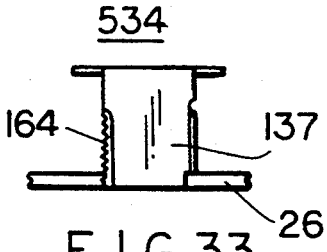
Figure 34:
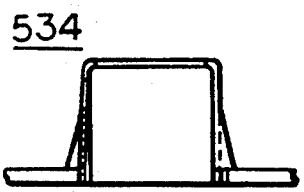
Figure 35:
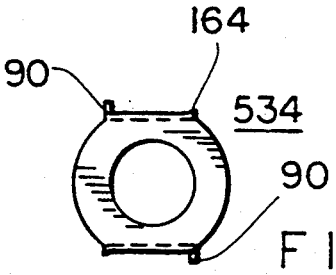
Figure 36:
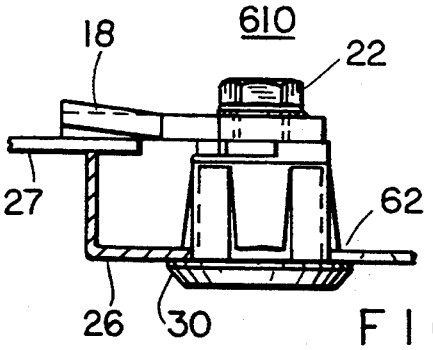
Figure 37:
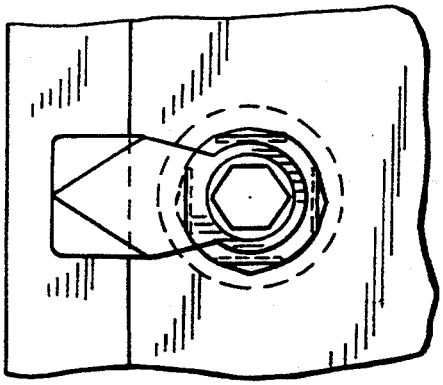
Figure 38:
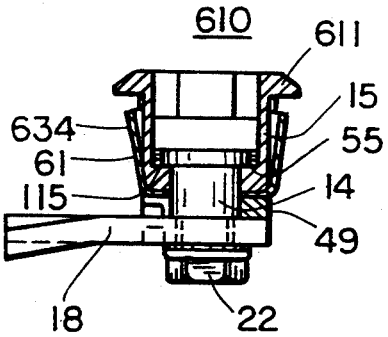
Figure 39:
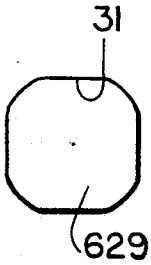
Figure 40:
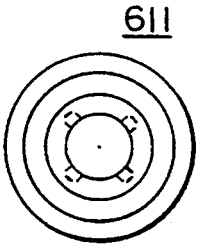
Figure 41:
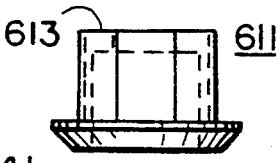
Figure 42:
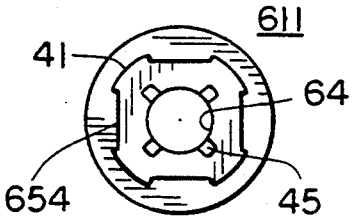
Figure 43:
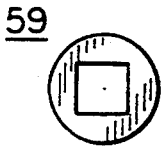
Figure 44:
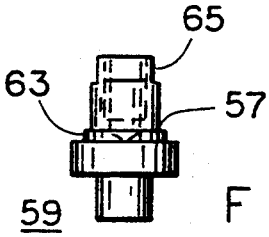
Figure 45:
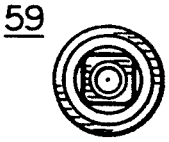
Figure 46:
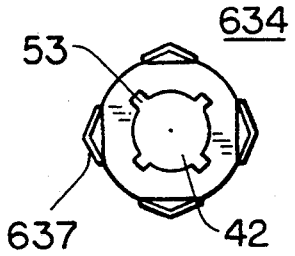
Figure 47:
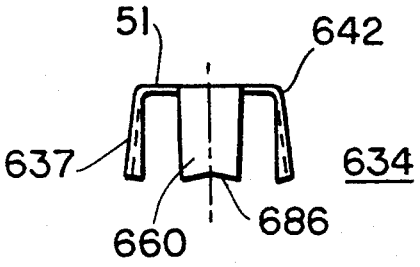
Figure 48:
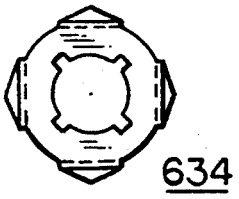
Figure 54:
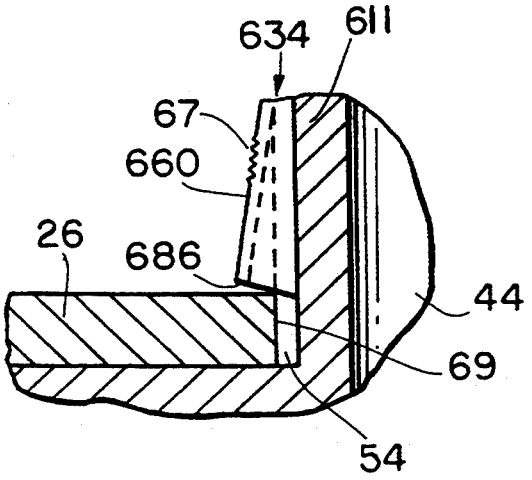
Figure 49:
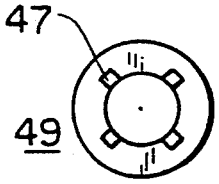
Figure 50:
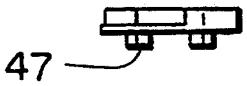
Figure 51:
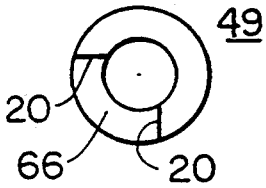
Figure 52:
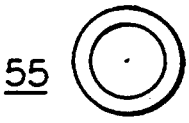
Figure 53:
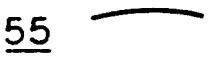
Figure 55:
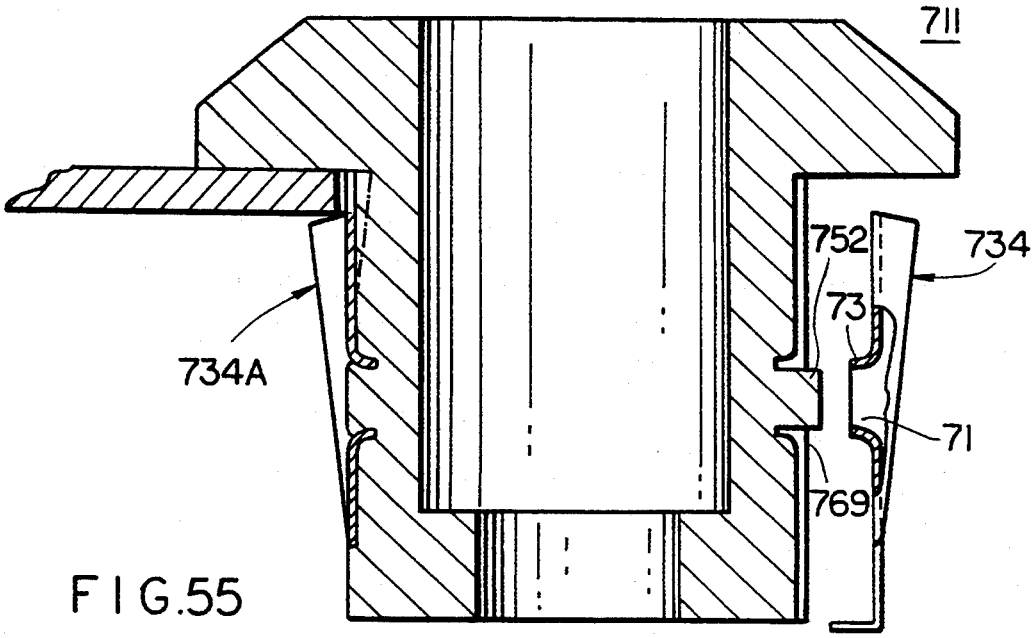
Figure 56:
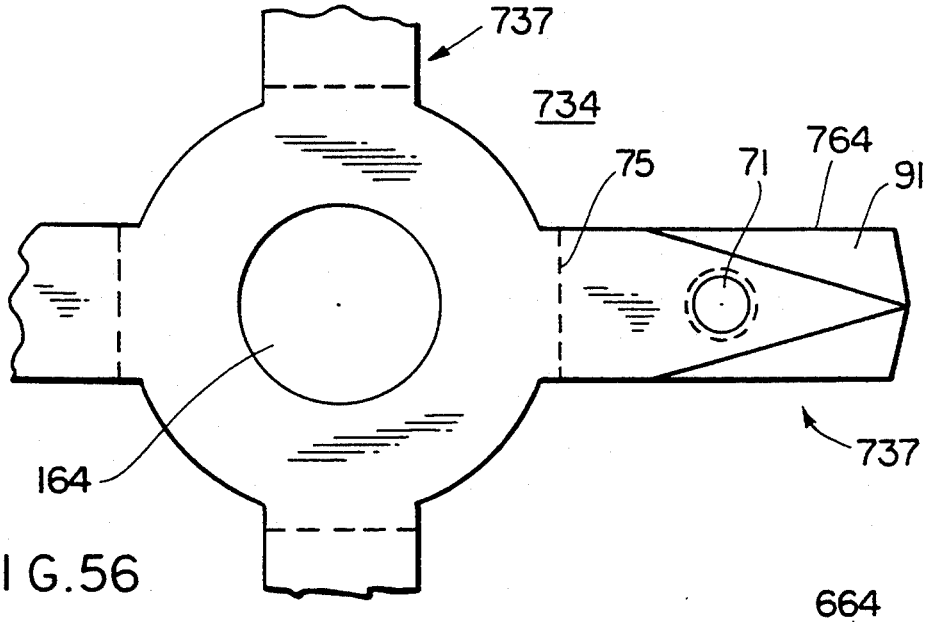
Figure 57:
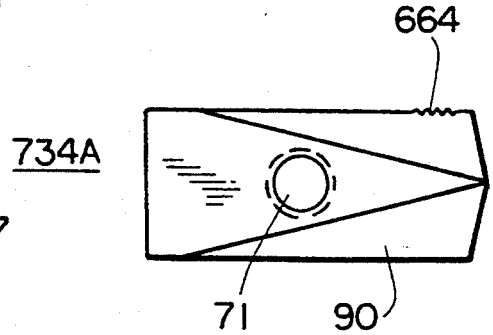
Figure 58:
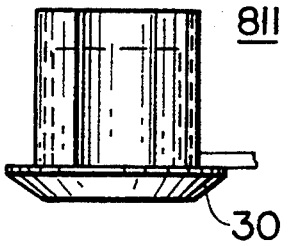
Figure 60:
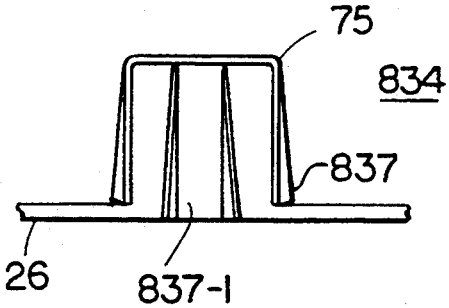
Figure 59:
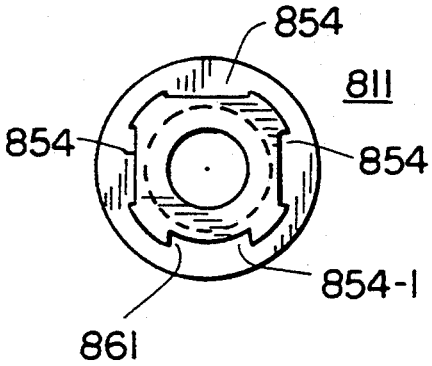
Figure 61:
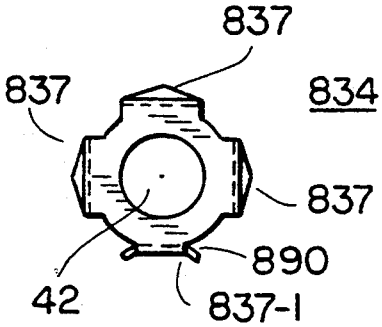
Figure 62:
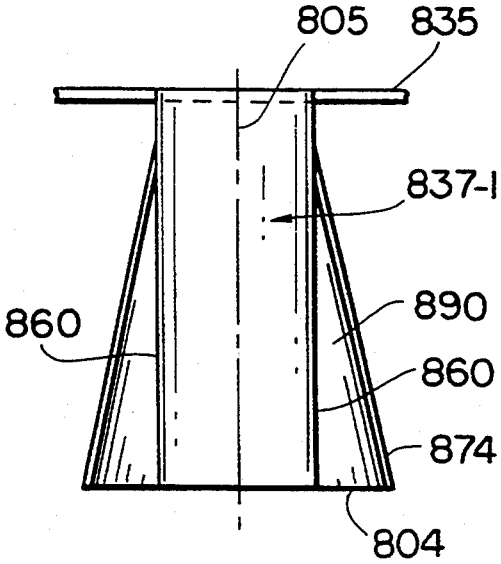
Figure 63:
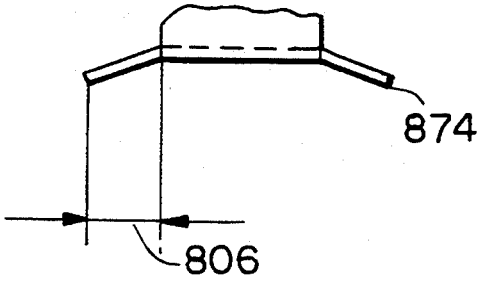
Figure 64:
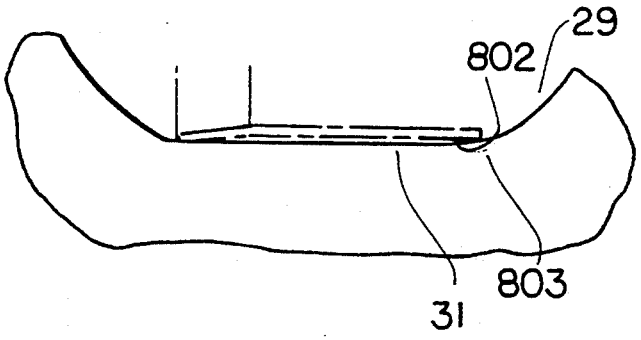
Figure 65:
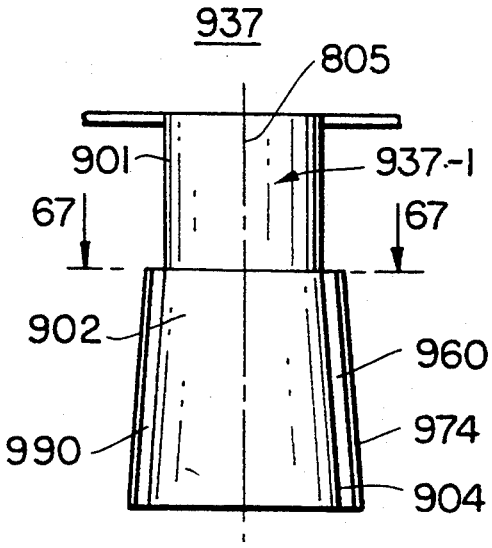
Figure 66:
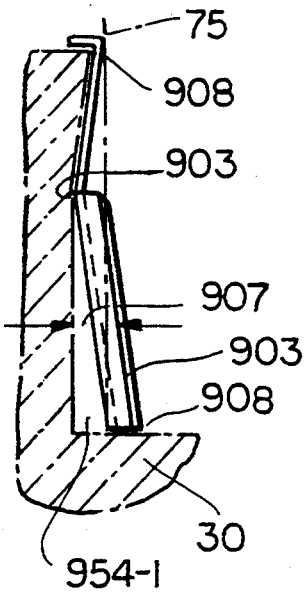
Figure 67:
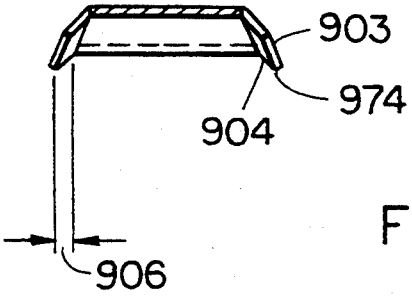
Figure 68A:
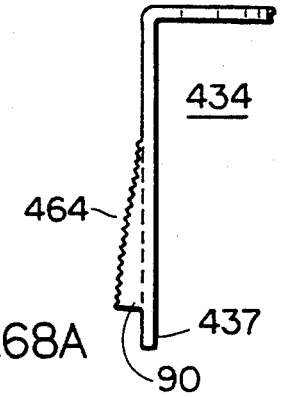
Figure 68B:
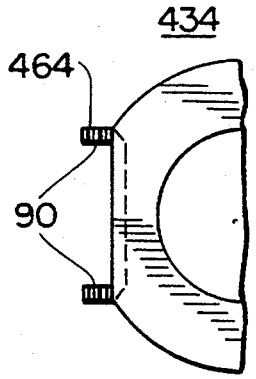

FIGS. 12 and 13 likewise show, in a side view and a view from the rear, a sash lock which can be blindly inserted into a sheet metal wall aperture and comprises a fastening spring which is U-shaped as seen from the side and is held by projections proceeding from the housing;

FIG. 14 show the shape of the aperture in a sheet metal wall adapted to the housing according to FIGS. 12 and 13;

FIGS. 15 and 16 show an embodiment form of a housing from the side and from the rear, which housing can be used in the lock according to FIGS. 12 and 13;

FIGS. 17 and 18 show a respective spring in a side view and in a view from the rear;

FIGS. 19 and 20 show another embodiment form of a housing for the lock according to FIGS. 12 and 13 in views similar to those in FIGS. 15 and 16;

FIGS. 21 and 22 show a correspondingly designed spring for the housing according to FIGS. 19 and 20 in views similar to those in FIGS. 17 and 18;

FIG. 23 shows the type of fastening by means of the spring according to FIGS. 17 and 18 in an enlarged view;

FIGS. 24, 25 and 26 show another embodiment form of a housing in a side view, in a side view partially in section, and in a view from the rear;

FIGS. 27, 28 and 29 show a respective spring in two side views and in a view from the rear;

FIGS. 30, 31 and 32 show another embodiment form of the housing in views similar to those in FIGS. 24, 25 and 26;

FIGS. 33, 34 and 35 show a respective spring in views similar to those in FIGS. 27, 28 and 29;

FIGS. 36, 37 and 38 show a side view, a view from the rear and an axial sectional view of another spring-fastened lock;

FIG. 39 shows the respective sheet metal wall aperture;

FIGS. 40, 41 and 42 show the respective housing in a view from the front, from the side and from the rear;

FIGS. 43, 44 and 45 show the respective lock core in a view from the front, from the side and from the rear;

FIGS. 46, 47 and 48 show the respective spring in a view from the front, from the side and from the rear;

FIGS. 49, 50 and 51 show three views of a respective fastening disk for the spring;

FIGS. 52 and 53 show two views of a disk spring arranged between the housing and lock core;

FIG. 54 is a view for explaining the fastening effect in the lock shown here;

FIG. 55 is a sectional view of a lock housing of metal or plastic with mounted individual spring (left) and cup-shaped or U-shaped spring (right);

FIGS. 56 and 57 show a top view of corresponding spring blanks, preferably consisting of spring metal such as steel;

FIGS. 58 and 59 show a housing according to another embodiment form in a view from the side and from the rear, respectively;

FIGS. 60 and 61 show the respective spring;

FIG. 62 shows the spring according to FIGS. 60 and 61 in an enlarged view from the side;

FIGS. 63 and 64 show front views of the "scraping leg" of the spring in two different insertion and scraping positions with respect to the mounting aperture;

FIG. 65 shows a somewhat different construction of a "scraping leg" of the spring in a view similar to that in FIG. 62;

FIG. 66 shows a side view of the "scraping leg" according to FIG. 65 in connection with a somewhat different construction of the respective housing countersink compared to FIG. 59; and FIG. 67 shows, a sectional view along arrow 67—67 of FIG. 65;

FIGS. 68A, B and 69A to 69D show views for explaining the scraping action of the grounding and fastening spring.

BEST MODES FOR CARRYING OUT THE INVENTION

FIG. 9 will be discussed first in order to explain the general problem addressed by the invention. FIG. 9 shows a side view of a so-called sash lock 10, as is commonly used e.g. in electrical switch cabinets, which is fastened in a sheet metal wall 26, such as a switch cabinet door, by means of grounding and fastening spring 34. It comprises a lock housing 11 in which an actuating shaft 14 having a T-handle 12 at its free end is supported so as to be rotatable e.g. by 90°. The angle of rotation is defined by a nose 16 which is attached on a sash tongue 18 supported by the other end of the shaft 14 and stops at two stop faces 20 of a cavity or depression 66 at the end of the lock housing 11.

The lock further comprises a housing with cylindrical receptacle space 60 for a lock core 9, the front end of the housing 11 passing into a flange 30 contacting one side 40 of the sheet metal wall, while the rear end of the housing 11 comprises a passage 64 for a lock shaft 6 connected with the lock core 32. In this instance the lock shaft 6 has a square end on which the sash tongue 18 is attached so as to be rigid with respect to rotation relative to it, e.g. by means of a screw bolt 22.

The sash tongue 18 is fastened to the actuating shaft 14 in this case by means of a screw 22 and slides with a sash surface 24 on a corresponding path (not shown) of the door frame when closing the switch cabinet door 26. The handle 12 can also be removed, e.g. in that a square is provided at the actuating shaft 14 inside the lock housing 10. A key provided with a corresponding square recess can be inserted onto the square. Other embodiment forms such as a triangle, double-beard, etc. are likewise possible, as is an inserted cylinder for a safety key.

The lock housing according to FIG. 9 is fastened in that it is first inserted through a corresponding aperture in the door leaf 26 by its rear lock housing part until it contacts the outer surface 32 of the door leaf 26 with its flange 30. A screw nut is now either screwed on to the thread 36 of the lock housing or, as shown in FIG. 9, a U-shaped plug-in spring is inserted into lateral grooves 40 in the lock housing 10 by its two legs in such a way that this spring is supported on the inner surface 42 on the one hand and on one side edge 44 of the grooves 40 on the other hand.

The spring comprises a tooth projecting in the direction of the surface 42 at the leg end 5, by which this tooth digs through possible coats of lacquer when the spring is inserted and produces a connection with the blank sheet metal of the door leaf 26 or the like.

A disadvantage here consists in the necessity of attaching this spring 34 from the rear after the housing 11 is inserted through the corresponding opening in the sheet metal 26. Moreover, the scratch caused by the tooth located on the spring 34 when inserting can be bothersome under certain circumstances because it could lead to rusting. It is also not certain whether or not the spring 34 will work itself out of its shown seat during shaking movements of the entire arrangement and then release the lock at some point in time.

Due to laterally arranged flattened portions 38 at the bearing housing which can be arranged either at one side only or at two or four locations which are offset by 180° or 90° relative to one another, the lock is secured against rotation if the aperture in the door leaf 26 is correspondingly provided with narrowed portions for these flattened portions 38.

Instead of the nut or the U-shaped spring clamp 34 which can be lost, FIGS. 10 and 11 show a lock housing 111 and 1011, respectively, in which the spring proceeds from the housing wall and forms one piece with the housing itself 111, 1011, respectively. As a result of this one-piece construction, it is not only impossible to lose the spring 46 and 146, but moreover, as will be described in more detail in the following, there is no longer a need to keep the door leaf 26 accessible from the rear, which would be necessary for inserting the fastening means of the plug-in spring 34 according to FIG. 9. Instead, in the embodiment forms according to FIGS. 10 and 11, the housing 11 and 1011, respectively., with the lock mechanism installed in the housing, e.g. the cross-pin 15 proceeding from a shaft 14, is inserted through a correspondingly shaped aperture opening 28, wherein the spring-like projections 46, 146 extending from the rear end of the housing 11, 1011 can be drawn back into corresponding depressions 48 in the outer surface of the housing 11, 1011 so as to spring out again due to spring force at the moment the flange 30 contacts the outer surface 32 of the door and, in so doing, contact the inner edge of the aperture 28 or the inner surface 42 of the door leaf 26 with their end face 50 so as to be supported and accordingly prevent the housing 11, 1011 from sliding out of the aperture 28 again. If the door is now closed and the shaft 14 with the cross-pin 15 is located in the indicated position, this pin penetrates a correspondingly shaped opening 52 in the door frame edge 54, which opening 52 is shown in a top view in FIG. 10A, so that after turning the shaft 14 by 90° the ends of the cross-pin 15 contact the edge surfaces 56 of the rear door frame surface 58 which have no lateral opening and accordingly hold the door 26 in the closed position, as shown in FIG. 10.

In this case also the lock housing 11 comprises flattened portions 38 so that the housing 11 in the aperture 28 is likewise secured against rotation.

The same applies for the embodiment form according to FIG. 11, in which the shaft 14 comprises an end part which is pressed flat in one direction and forms an arrow with an undercut in the direction perpendicular to the latter direction (see the view in FIG. 10), so that the door can simply be slammed in the shown locking position, wherein the pointed part 17 of the shaft 14 forces its way between the springing resilient jaws 19 of an abutment 21 fastened at the door frame 54, wherein a locking is formed by the inwardly directed hook-shaped ends in the end position shown here. The flat portions at the hooks and the end part 17 can be drawn out again and the door can be opened by turning 90°.

The advantage of the two locks shown in FIGS. 10 and 11 compared to a sash tongue lock, e.g. according to FIG. 9, is that the shaft 14 is loaded only in the axial direction, whereas in the embodiment form according to FIG. 9 a bending load occurs which, like the axial loading of the housing, must be transmitted to the door leaf 26 and exerts compressive stress on the housing tongues at one side of the housing.

An embodiment form is now described with reference to FIGS. 1 to 5 which was also used in modified form in the construction according to FIG. 10.

The lock housing designated here by 111 comprises a housing wall 4 which encloses a cylindrical receptacle space 60 and passes into a flange at the front end of the housing, while a housing base 62 closes the space 60 at the rear end and comprises an aperture opening 64 axially for receiving the actuating shaft, not shown here. As shown here, the base 62 can form a guide path 66 forming two stop faces 20 for a nose proceeding from a sash in a manner similar to the embodiment form according to FIG. 9.

The arrangement of two springs 46 which proceed from the housing wall 4 in proximity to the end 68 of the housing and are injection molded from plastic, e.g. polyamide, so as to form one piece with the housing 111 is essential to the invention. As can be seen, the end 68 of the housing comprises a round cross section with four flattened portions 38 which are offset relative to one another by 90° see FIG. 3. Whereas the flattened portion 38 which faces away in FIG. 1 as viewed by the observer is continuous from the end 68 of the housing to the flange 30, see also FIG. 2, the corresponding flattened surface in the area of the spring 46 extends only as far as the spring opening 70 and opens out in this location into the spring 46 on the one hand and into an offset surface 72 on the other hand, whose purpose is to receive the spring 46 when the housing is inserted through a corresponding aperture in the door leaf, which aperture is provided with four narrowed portions for the flattened portions 38 of the cross section of the housing base 68. As soon as the aperture edges reach the spring opening area 70 and the housing is inserted further, the spring 46 is pressed inward in the direction of the offset surface 72, wherein this offset has a depth C (FIG. 3) such that the thickness A of the spring 46 can be substantially received. If necessary, particularly if the spring has the V-shape at its end shown here, it can be sufficient that the offset depth C is only equal to or somewhat greater than the material thickness of the spring, since it would also be conceivable to flatten the V-shape into a straight shape simultaneously during the bending in. It is advisable to keep the width of the spring, D, equal to or somewhat smaller than the width E of the flattened portion 38 so that the spring 46 is pressed inward by the corresponding straight-line chord-like area of the circular narrowed portion of the door aperture, but not by the circular area. This improves the guidance accuracy and the accuracy of the angular alignment of the housing in the aperture opening.

Figure 4:
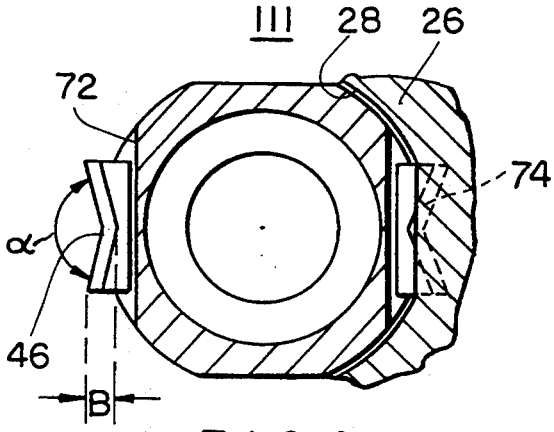
FIG. 4 is a sectional view along section line IV—IV of FIG. 1.
Figure 5:
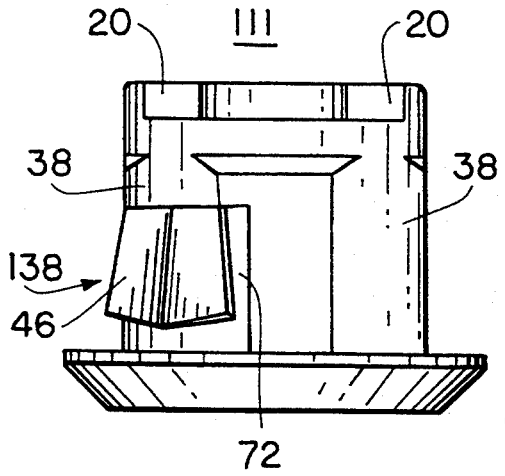
FIG. 5 is a side view of another embodiment form of the housing, according to the invention.

The spring rigidity of the spring 46 depends on the material thickness at the spring opening 70 as well as on the material thickness of the free spring length adjoining it, and further on the extent of the V-shaped bending which can be seen particularly clearly in FIG. 4 and which increases continuously proceeding from the spring opening 70 and reaches a maximum at the end of the spring, which maximum is shown in the drawing and has an angle of approximately 165° in the embodiment form shown here. The angle at the spring opening 70 on the other hand is 180°.

Figure 1:
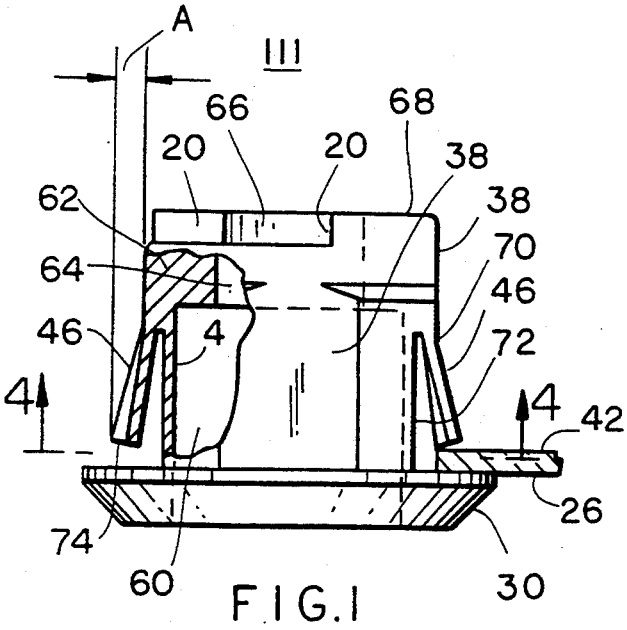
FIG. 1 shows a first embodiment form of a housing constructed according to the invention, partially in section.
Figure 2:
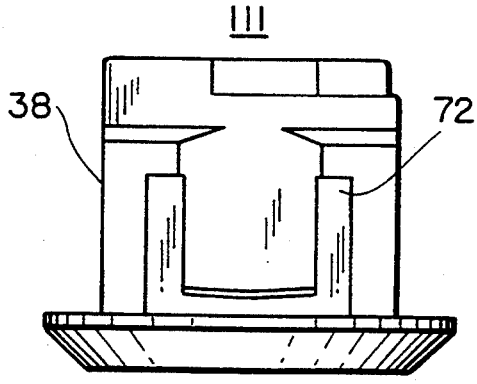
FIG. 2 is a view from the right of the housing shown in FIG. 1.
Figure 3:
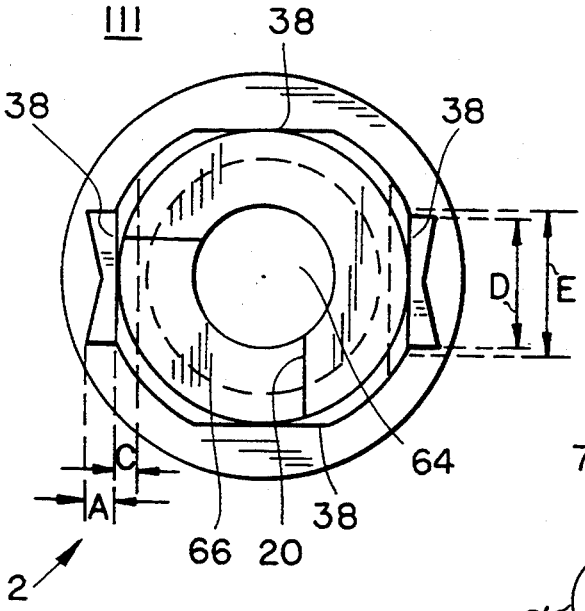
FIG. 3 is a view from the rear of the housing shown in FIG. 1.

FIG. 4, a sectional view along arrows IV—IV of FIG. 1, also shows that the material thickness of the spring 46 is substantially equal along its entire width as well as along its longitudinal extension. At the same time, the spring force increases in strength relative to the bending toward the end of the spring because of the increasingly tapered V-shape, i.e. the decrease in the angle $\alpha$. This is advantageous insofar as the spring 46 then contacts the rear surface 42 of the door leaf sheet metal 26 with a particularly rigid tip 74, see the right-hand side of FIG. 4, where the spring tip 74, which is strengthened as a result of the V-shape, contacts the area of the aperture 28, which is narrowed here in a chord-like manner, after the housing has been completely inserted through this aperture and the spring 46 which is first pressed into the offset surface is released again and first slides over the corner of the sheet metal of the door leaf 26 with its end face 74, which is somewhat beveled outward, and subsequently springs out again and, with its end face 76, securely contacts the area of the surface 42 of the door leaf 26 located around the aperture 28.

Figure 6:
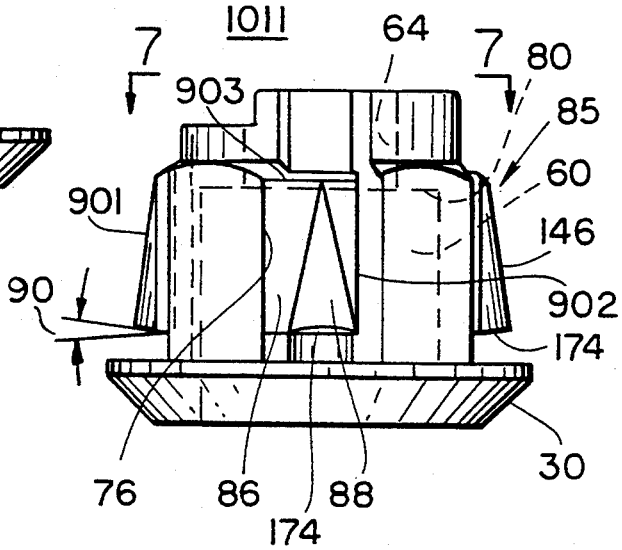
FIG. 6 is a rear view of the housing according to FIG. 5.
Figure 7:
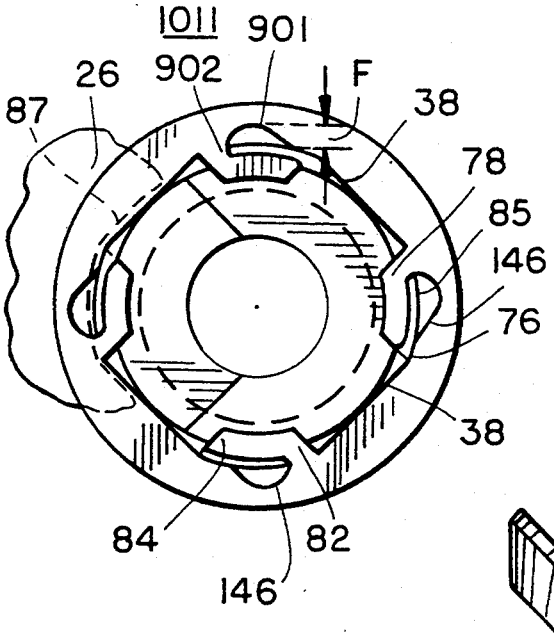
FIG. 7 shows a side view of the housing of FIG. 5 which is turned by 45° relative to FIG. 5.
Figure 8:
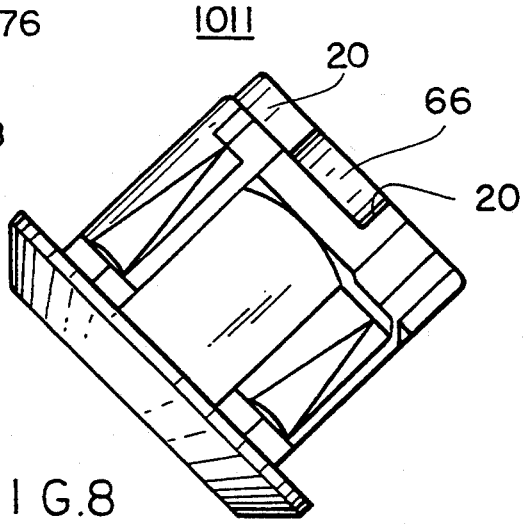
FIG. 8 shows a side view of the housing of FIG. 6 which is turned by 45° relative to FIG. 6.

FIGS. 6, 7 and 8 show another embodiment form in which the spring 146 does not proceed from the end 68 of the housing, but rather from fixed ends 76 which are formed by axial depression areas 78 formed between flattened area 38. Moreover, the housing according to FIG. 6 has a very similar construction with respect to the flange 30, receptacle space 60, support or base surface 80, respectively, for a lock core, not shown, and a bore hole 64 for the actuating shaft (on which e.g. a sash 18 can be placed and fastened by a screw 22, wherein the sash simultaneously holds the lock core in the receptacle space 60). Springs 146 can also proceed from the two side edges 82, 84 of the depression area 78, but a more favorable spring action results with a longer extension of the springing area, so that the space is more advantageously used by only one spring which proceeds in this case from the side edge 84.

The space 78 is again just sufficient for enabling the spring 146 to duck away when the housing is inserted into a corresponding aperture provided with narrowed portions for the flattened portions 38, wherein the spring 146 is designed in such a way that it just contacts the curved opening area of the aperture in the door leaf 26, see the dashed line 87 in FIG. 7, first at the upper housing in proximity to the base, see reference number 85 in FIG. 7. The spring then springs increasingly further in the direction of the flange 30 with its free end 902, so that it finally lies with its engaging surface 174 behind the sheet metal of the door leaf 26. Free end 902 is substantially parallel to fixed end 76. The engaging surface 174 is sufficiently large to hold the lock housing securely in the aperture of the door leaf 26. Engaging surface 174 is substantially parallel to first end 903 and first end 903 is substantially perpendicular to fixed end 76 and free end 902. In the embodiment form shown here, the spiring 146 is designed in such a way that, at first, it has a constant thickness (reference number 86) proceeding from the fixed end 76, and then passes into an area 88 which becomes increasingly thicker situated on the surface 86 with uniform material thickness and thus forms a conical thickened portion having an outermost surface 901 on top of the normal material thickness which reaches a thickness F, shown in FIG. 7, proceeding from the tip of the cone at zero. The thickness of the thickened portion is such that it can just be received in the depression area 78, i.e. the conical area 88 can be completely received in the depression area 78 when the spring is bent around the fixed end 76.

As can be seen, the springs 146 are supported in the embodiment form shown in FIGS. 6, 7 and 8 in the curved areas of the aperture, whereas in the embodiment form according to FIGS. 1 to 5, it is the straight-line, chord-like areas of the aperture on which the springs 46 are supported.

The previously described lock housings, according to the invention, according to FIGS. 1 to 9 and 10 and 11 are inexpensive to produce and assemble. Moreover, they cannot be disassembled without special tools and are therefore well protected against theft of the lock (which often happens e.g. in mailbox installations).

However, this is also true for the lock housings shown in the additional FIGS. 12 to 67 in various views and embodiment forms, in which additional embodiment forms the spring 34 (234 in FIGS. 12 to 18; 334 in FIGS. 19 to 23; 434 in FIGS. 24 to 29; 534 in FIGS. 30 to 35; 634 in FIGS. 36 to 54; 734 and 834 in FIGS. 55 to 57; 834 in FIGS. 60, 61) is a metal part which is rigidly connected axially to the housing or the housing wall 11 (or 211 in FIGS. 11 to 18; 311 in FIGS. 19 to 23; 411 in FIGS. 24 to 29; 511 in FIGS. 30 to 35; 611 in FIGS. 36 to 54; 711 in FIGS. 55 to 57; 811 in FIGS. 58, 59), wherein the metal is preferably spring metal such as steel. The housing can likewise be die cast from a metal, e.g. die-cast zinc, or can also consist of plastic. This spring 34 consisting of metal can be bent in a U-shaped manner (FIGS. 12 to 35) or in a cup-shaped manner (FIGS. 36 to 61), so that the spring grasps the rear end of the housing with the U-web 35 or cup base, is axially supported at the rear end or in proximity to the rear end, and is supported on the other side 48 of the thin wall by the ends of the U-leg or cup rims. The U-legs 37 of the spring 37, which is U-shaped as seen from the side, are preferably arranged in the area of the flattened portions 38. On the other hand, the cup wall of the cup-shaped spring (e.g. 634) comprises four legs 637 which are offset by 90° relative to one another, wherein the legs lie in the area of a flattened portion 654 of the housing. The spring can be held by a projection or protuberance (e.g. 152 in FIGS. 15, 16; 752 in FIG. 55) proceeding from the housing, or the spring is held by offsets (e.g. 178 in FIGS. 24 to 26) at the circumferential surface of the housing 411. Alternatively, the spring can be held by a spring part comprising end hooks (e.g. 168 in FIGS. 21 to 22) which extends through the sheet metal wall aperture 29. However, the spring can also be held by a disk (49 in FIG. 38) placed on the end face of the housing. Offsets (e.g. 154 in FIG. 16, FIG. 26; 654 in FIG. 42) are provided in the housing wall for receiving spring parts which project forward in the rest state.

As already mentioned, such a spring, which can be fastened at the lock, can be produced e.g. in that a blank of the spring (see e.g. FIGS. 55, 56, 57) of sheet steel can first be formed accompanied by simultaneous shaping of openings, eyes, edges and/or folds, in that the spring blank is subsequently hardened and the spring is finally placed on the housing of the lock. After the latter process, the spring (e.g. 734) can be fixed at the housing (e.g. 711) by means of a part which can be securely connected with the housing or which can be securely connected with a part (e.g. shaft, tongue) projecting from the housing. This fastening can be effected by gluing or by pressing tongue-and-groove devices (e.g. 45, 47 in FIGS. 36 to 54) on the parts (49, 611) to be fastened together. But the fastening can also be effected by means of flattening out housing projections (e.g. 752 in FIG. 55) guided through openings (e.g. 71 in FIG. 55) in the spring (possibly with the application of heat when using plastics).

The embodiment forms of FIGS. 12 to 56 will now be discussed in detail:

FIG. 12 shows a lock 210 constructed according to the invention which is fastened in a door leaf 26 and engages a door frame part 27 with the stop surface 24 of its tongue 18. The door leaf 26 comprises an opening or aperture 29 which is substantially circular with two chord-shaped narrowed portions 31. The circumferential area 33 of the housing 211 of this lock 210, which can be seen in a side view in FIG. 15 and in a view from the rear in FIG. 16, is constructed in a corresponding manner. A spring 234, which is constructed in a U-shape as seen from the side, is provided for the housing fastening and on a projection 152 which proceeds from the flattened side, or more exactly, from a recess 154 arranged at this flattened side, and extends up to the plane which would normally be formed by this flattened portion and which are also defined by the end areas 156 of this recess. The spring 234 fits into this recess with its legs 37, wherein the projections 52 penetrate into corresponding openings 158 in the spring after this spring is arranged on the housing 211 from the rear. The spring thickness is then substantially received by the depression 154 and the spring is held in position by the projection 58. The spring 234 is bent outward along a bending line 160 at an angle 62 of e.g. approximately 10° to 20° as can also be seen in FIG. 18. The spring contacts the edge 162 of the sheet metal wall 26 with this bend, see FIG. 23, and accordingly secures the housing 11 in connection with the flange 30.

In order also, if necessary, to produce an electrical connection between this spring 37 and the metal of the wall 26, which is particularly important when the material of the housing 11 itself is a nonconductive plastic, as is also the case e.g. according to FIG. 38, one side edge of the leg 37 advantageously comprises a toothing 164 (FIG. 23) which scrapes along the aperture edge 166 and abrades it when inserting the housing provided with the spring through the aperture 29. Since the leg 37 also has a width increasing slightly in the direction of the U-web 35, this toothing 164 digs increasingly into the sheet metal and thus ensures an electrical connection, even if lacquer residue or oxide films had been present on the sheet metal beforehand.

This electrical connection between the sheet metal of the wall 26 and the metal material of the spring 37 also succeeds in producing an electrical conducting path between the wall 26 and the shaft 14 with adjoining key and sash tongue 18 when the housing 11 comprises insulating material: since the fitted on spring 634, the disk 49, the shaft 14 and the handle or key usually consist of metal for reasons of strength and the disk 44 according to FIG. 38 and tongue 18 according to FIG. 12 contact the web-shaped end 35 of the spring 234, and since, in turn, an electrical connection with the lock core, which likewise consists of metal, and with the shaft 14 is produced via the fastening bolts 22, likewise consisting of metal, the handle or key is also electrically connected with the metal of the wall 26. In the case of an electrical switch cabinet of sheet steel, the door frame is accordingly designated by 26, and the risk that wires which dangle inside the switch cabinet, conduct electrical voltage, and come into contact with the tongue 18 will transmit a dangerous electrical voltage to the key 14 is eliminated, since this voltage is harmlessly diverted to the door frame and accordingly to the switch cabinet housing.

FIGS. 19 to 22 show another construction of the housing 311 and fastening spring 334 in which the spring has bends 168 facing outward at its leg ends, which bends 168 lie along the rim 166 of the aperture and accordingly secure the spring axially at the sheet metal of the wall 26. In order to receive this bend 168, the flange 30 comprises a corresponding depression 170 in the contact surface, which depression 170 contacts the surface 32 of the door leaf 26 when the lock is inserted through the aperture opening. Otherwise, the housing 311 likewise comprises a recess 154 for receiving the U-webs 37 of the U-shaped spring 334, similar to the embodiment form according to FIGS. 15 and 16. In the embodiment form shown in FIGS. 21 and 22, the spring 334 comprises two bending lines 160 so that two bent areas 172 result which are supported on the edge area 162 of the door leaf 26 after pushing through the spring. Teeth (not shown) can also be provided here for producing grounding contact if necessary. Teeth can be provided e.g. at the edges 174 of the bends. Moreover, reference is made to a bending out 176 from the inner annular area of the U-web 35 of the spring 334 which serves to exert a defined pressure on the tongue 18 sliding on this annular surface and thus to produce a constant scraping and sliding contact and accordingly a good grounding connection.

Another construction can be seen in FIGS. 24 to 29, wherein a spring 434 is supported on lateral notches 178 in the outer wall of the housing, specifically with projections 80 as can be seen in FIG. 28.

As can be seen in FIG. 26, the circumferential area 33 of the housing 411 is outfitted in this instance with two opposite recesses 154 which are not planar, as e.g. in the embodiment form according to FIGS. 16 and 20, but have a circular shape coaxially to the overall housing cross section. The wedge-shaped notch 178, which itself forms a straight inner edge 82 (FIG. 25) at which the end face 84 of the projection 80 is supported, proceeds from this circular surface with reduced radius. The projection 80 comprises resilient material, like the entire spring 434, so that the U-shaped spring 434 can be placed over the housing 411 from the rears wherein the projections 80 first spring back and then lie in the notches 178 as soon as the spring 434 has reached the position in which it is completely mounted on the housing 411.

It is worth noting that the leg ends 86 of the spring 434 extend up to the inner surface 88 of the flange 30, so that these leg ends contact the aperture edges of the door leaf sheet metal 26 when the housing 411 provided with the spring 434 is subsequently inserted into the door leaf opening which has an aperture shape similar to that of FIG. 14. During this insertion, bends 90, which proceed from the legs of the spring 34 and widen in a wedge-shaped manner toward the ends of the legs, also engage in a working connection with the aperture edge with the purpose of removing lacquer or oxide film or, if necessary, producing a grounding contact. As can be seen in FIG. 26, the circular notch 178 also serves simultaneously as a receptacle space to accommodate the yielding of the two sides of the spring legs which are not bent, so that this scraping action is effected under the force exerted by the bending back of the legs when pressed into the offset 178. As soon as the front end 92 of the projecting bend is reached, the leg springs back again into the position shown in FIG. 28 and contacts the rear surface 42 of the door leaf sheet metal 26 and accordingly locks the entire arrangement in the door leaf 26. According to FIG. 29, there are four such bends resulting in a very secure fastening in the door leaf. At the same time, there are two contact surfaces of the spring 434 at the door leaf material, one due to the projecting edges 90 with their front edges 92 on the surface 42 and the other with the projecting areas 86 at the inner aperture surfaces of the door leaf 26.

FIGS. 30 to 35 show a housing 511 and a respective spring 534 in which an asymmetrical shape and recess, provided with reference number 254, is selected. Only one bend 90 is provided for the one side of the depression 254 which is cut out more deeply, while only a sawtooth 164 is provided for the other, flatter side of the depression 254. In this case also the legs 137 of the spring extend with their end part as far as the inner contact surface 88 of the housing 511 and accordingly, in the mounted position, contact the aperture edges of the door leaf 26. The sawtooth-shaped part 164 carried by one side edge of the legs 137 accordingly also extends as far as the area of the aperture and accordingly ensures a grounding of the lock, if desired. No special step is necessary here for fastening the spring 534 axially at the housing 511. A construction according to the embodiment form of FIGS. 24 to 29 is also conceivable, or an embodiment form according to FIGS. 14 to 18 or according to FIGS. 19 to 22.

FIGS. 36 to 54 describe an embodiment form in which the spring is not U-shaped, but rather cup-shaped, wherein the aperture provided for this lock is provided with four chord-like narrowed portions 31, e.g. as in the construction shown in FIG. 10. The housing 611 correspondingly comprises offset areas 654 in addition to outer surfaces 41 in the form of circle segments. The offset areas 654 provide space for a deflection of the four legs 637 of the cup-shaped spring 634. These legs 637 each comprise a bending line 660 at which the legs are bent in a roof-shaped manner, specifically again so as to be shaped in such a way that the angle enclosed by the roof shape becomes increasingly smaller toward the free end of the legs starting at 180°, see reference number 686, while the angle at the planar start 642 of the leg is 180°, as already mentioned. When inserting the housing 611 provided with the attached spring, the aperture edge of the aperture 629 can accordingly bend the leg 637 straight (i.e. to almost 180°) also in the area of the increasingly thick roof shape and thus press it into the offset area 654. As soon as the flange area 30 contacts the surface of the door leaf 26, the end faces 686 of the spring 637 spring back again into their U-shape (the roof shape in this instance), as already mentioned, and contact the edge surface 62 of the door leaf 26 and accordingly secure the hold of the lock 610.

FIG. 38 shows that the spring 634 is fastened in this case in a somewhat different form at the housing 611. That is, this housing 611 comprises depressions 45 which are set back radially from the passage 42 for the lock shaft 14 in the area of the rear end 613 of the housing 611. Projections 47 of an end disk 49 (FIGS. 50, 51) can catch in these depressions 45, the cup base area 51 of the cup-shaped spring 634 being clamped in between the depressions 45 and the end 613 of the housing 611. For this purpose, this cup base area 51 comprises notches 53 which allow the projections 47 to pass. A depression 66 which is possibly provided for the nose 16 of a sash tongue 18 and forms the stop faces 20 can then be formed by the disk 49, see FIG. 51. The disk 49 can comprise electrically conducting material, such as metal, or electrically conducting plastic so as to provide the possibility again, if necessary, of producing an electrical connection of the fastening spring 634 with the tongue 18 via the disk 49 and accordingly also with the lock core, including the lock shaft 14, the lock core likewise consisting of metal. However, this also causes an electrical grounding of the actuating key inserted on the square of the lock core shown here (see FIGS. 43 to 45) so that the necessary potential balancing junction between the actuating key and the switch cabinet door would be produced.

In the square plug-in lock shown here a frictional locking against rotation is effected by means of a disk spring 55 shown in a top view in FIG. 52 and in a side view in FIG. 53. The disk spring 55 is arranged between the inside housing supporting surface 55 (see FIG. 38) and a corresponding supporting edge 57 of the lock core 59 (see FIG. 44) and causes a defined friction which is desirable in this case. Further, an O-ring seal 61, for which a corresponding annular space is made available by the lock core 59, see reference number 63, can be seen in the sectional view through the lock 610 shown in FIG. 38. The fastening of the disk 49 on the housing 611 can be effected by means of the tongue 18 secured by the screw bolt 22 in the event that no trouble is caused by the additional axial load resulting from this, which axial load is transmitted from the spring 634 to the disk 49 and from the latter to the tongue 18, from which this axial load is transmitted via the screw bolt 22 screwed into the threaded bore hole 65 of the lock core 59 and finally, via the surface 57 and the disk spring 55, to the contact surface 15 of the housing base, i.e. leads to an additional friction caused by the axial load. However, as an alternative, the disk 49 can also be fastened at the housing 611 in a different manner, e.g. by gluing the projections 47 into the offsets 45.

The lock can then be disassembled by loosening the screw bolt 22, e.g. for the purpose of exchanging the lock core, without the parts 49, 634 and 611 falling out.

FIG. 54 again shows how the edge 686 of the spring 634 holds the housing 611 at the door leaf 26. If the spring is to have a lacquer-scraping effect again, this could be effected e.g. in that a toothing 67 is arranged on the bending edge 660, which toothing 67 scrapes off lacquer and oxide residues, particularly on the aperture edge or interior 69, and exposes a blank metal surface in the entire area of this aperture and accordingly provides the likewise metallic end face 686 with the possibility of a grounding contact, as can also be seen in FIG. 54.

In the embodiment form according to FIGS. 36 to 54, when a permanent fastening between the disk 49 and the housing 611 (e.g. by gluing) is not carried out, for example, because the axial loading is not troublesome, it is possible to disassemble the entire arrangement, i.e. including the disassembly of the spring 634 from the housing 611 and accordingly also the disassembly of the housing 611 from the aperture opening 629, in a simple manner by removing the screw 22. If this provision for removing the screw 634 from the housing 611 is not made, disassembly can be carried out with special tools which press back the projecting parts holding the spring 634. This also applies to the embodiment forms according to FIGS. 12 to 35.

Another advantage of the embodiment form with two-part housing, wherein the two parts are not permanently connected, consists in that assembly may be effected while the fastening screw 22 is still loose, the screw being tightened only after assembly so that a more exact fastening in the aperture would be conceivable.

All of the shown embodiment forms have the advantage that an inexpensive plastic housing without threads can be used. The omission of the thread has the advantageous effect that no so-called split injection molding die is necessary, i.e. the tooling costs for the production of the plastic housing are simpler and accordingly less expensive. For the purpose of a grounding effect, if desired, it is only necessary, as already mentioned, to manufacture the disk-shaped end piece 49 from metal in the embodiment form according to FIGS. 36 to 54, which brings about lower costs. The lock core and the other movable parts of a lock are to be manufactured from metal in any event for reasons of mechanical strength, so that the advantageous grounding connection path already described results in this way. The advantage of the clip fastening by means of the fastening spring described here has the advantage that no "wrench freedom" is necessary on the rear of the door leaf 26 for mounting a fastening nut or fastening spring according to FIG. 9. Another advantage consists in the anti-theft protection, since it is difficult to dismantle the lock used with the clip fastening. As already mentioned, a special tool is needed for this purpose which is usually not carried by an unauthorized person.

If a stop, realized in the construction according to FIG. 36 by the stops 20 in the disk 49, is not required or if this stop is situated in the interior of the lock, e.g. in that a projection and a corresponding path defining the movement of this projection are formed by the lock core or by the inner surface of the housing, the disk 49 can also be dispensed with and the spring 634 can be held directly by the sash tongue 18. Of course, the disadvantage that the sash tongue and screw must also absorb the fastening forces of the fastening spring 634 in this case cannot be concealed. In order to avoid this, the sash housing can be provided with projecting protuberances as described in the embodiment form of FIGS. 12 to 18.

Under very simple circumstances, however, the pressing action of the fastening spring 634 may also be desirable, e.g. when the disk spring 55 is to be dispensed with. In this case, the fastening spring 634 takes over the production of frictional pressure.

Such friction due to axial forces is always required e.g. when a lock is to be operated by an insertable key. Friction can be dispensed with when there is a cylinder lock which automatically holds the lock in the closed or open position.

In the embodiment forms of FIGS. 27 to 29 and 33 to 35, the bends 90 of the fastening spring are carried out at 90°. A smaller bend can also be effected instead of a 90° position, which would enable a greater compensation of tolerances.

The shown locks with cylinder lock, according to FIG. 12, are particularly well-suited as mailbox locks, since they cannot be disassembled by an unauthorized person and then misappropriated for his personal use because disassembly is only possible by means of special pliers.

A projection proceeding from the housing 11 and serving to fasten the spring need not necessarily have the form shown e.g. in FIG. 15. FIG. 55 shows a housing 711 with a projection 752 having undercuts 769 for receiving the wire edge or fin 73 occurring when punching out an opening 71, wherein e.g. the opening 71 may be a part of a cup-shaped spring 734 or an individual spring 734A which is shown while still in the flat blank shape in FIG. 56 and FIG. 57. This figure clearly shows how simple the production of such a spring can be: the shape shown in FIGS. 56 and 57 is punched out of corresponding hardenable flange steel material, provided witch the eyes 71, with parts 90 to be bent (see e.g. the corresponding bends in the other embodiment forms), with a toothing 664, e.g. at the edge of the bend 90 and (at FIG. 56) with the center hole or passage 164 for the actuating shaft of the lock on which the spring is later placed, and then the four spring legs 737 of the spring 734 are brought into a cup shape at the corresponding bending edges 75, or the individual spring 734A is punched and the spring is then hardened.

As follows from FIGS. 58 to 66, a spring having a plurality of legs, e.g. like the shown cup-like spring 834, can be provided with three legs 837 which substantially serve for fastening purposes, while a fourth leg 837-1 is constructed chiefly for scraping off lacquer and for producing a good grounding contact. For this purpose, the aforementioned legs 837 have a shape similar to that described in connection with FIG. 47 for the legs 637 of the spring 634. The respective sash housing 811 correspondingly comprises three depressed areas 854 which are dimensioned in such a way that they flatten the legs 837 bent into the V-shape when inserting the sash housing with mounted spring and the entire arrangement through an aperture, as is shown e.g. in FIG. 39. On the other hand, the fourth leg 837-1 is outfitted with scraping strips 890 which face outward, similar to the embodiment form of FIG. 29, wherein however the scraping strips do not extend vertically relative to the base plane of the leg, but are constructed diagonally relative to it, resulting in a strip having walls which face outward diagonally in the section according to FIG. 61. The respective depression area of the housing 811, see reference number 854-1, is constructed correspondingly in a manner similar to FIG. 26, namely with its surface area coaxial to the housing bore hole and accordingly with recessed side notches 801 for receiving the legs 890 when inserting the housing 811/provided with the spring into a thin wall.

This specially constructed spring leg is shown again in FIG. 62 in an enlarged view from the side and in FIG. 63 from above, while in a view similar to that in FIG. 63, FIG. 64 shows this spring in a position in which it is bent substantially straight when reaching the end 804. The opening edge of the aperture 29 in the thin wall, which opening edge is formed by the narrowed portion 31, is freed of lacquer and oxide residues in area 803 by the scraping edge 874.

Since this edge 874 does not extend parallel to the axis 805 of the leg 837-1 like bending line 860, but rather increases its distance from it proceeding from the cup base of U-web 835, this edge 874 shaves an area (from 802 to 803) of the aperture edge area formed by the chord 31 during the insertion, which area (from 802 to 803) moves further outward in a continuous manner. This is equally true for the other side of the leg 837-1. Accordingly, an area characterized by reference number 806, FIGS. 63, 64, is scraped free, wherein this shows the "scraping path" or stroke of the scraping process.

Since a division of labor is effected in this embodiment form in which three webs 837 have a holding function and one web 837-1 has a scraping function, but less of a holding function, it is advisable to effect the arrangement of the depressed areas 854 and the respective legs 837 in such a way that the tongue lies in the direction of the area 854-1 or 837-1 in the closed state. In this position, the sash tongue is loaded by the closing force in the direction of the rear end of the housing 811 and in so doing exerts a bending force on the housing in turn with reference to the thin wall, which causes a lifting of the housing flange 30 from the thin wall 26 at the side of the housing opposite the tongue. Accordingly, the fastening spring 834 and the corresponding leg 837 (which should then lie exactly opposite the scraping leg 837-1) must absorb the most force. This means that the tongue in its closed position should be aligned with the web 837-1 provided for the scraping function.

The legs 837 shown in the embodiment form according to FIGS. 58 to 61, which are provided only for holding purposes, can also have any leg shape other than that described in the preceding insofar as they are particularly well-suited for holding purposes. This means that the embodiment form shown here is only an example for a mixed construction which distributes functions.

FIGS. 65 to 67 show a somewhat modified embodiment form of such a scraping arrangement serving for grounding purposes in one of a plurality of legs 937 of a cup-like fastening spring 937. The leg 937-1 first comprehends an area 901 which is kept flat without bending outward and has a bend (see FIG. 66) extending slightly inward in the direction of the housing body, not shown here. A second area 902, which is again directed away from the housing wall, adjoins at a bending line 903 and further receives two bends 990 in that the rim areas are bent out at a bending line 960, similar to the embodiment form of FIG. 62 at bending lines 860. However, these bending lines 960 are not parallel to the axis 805 in this case. Rather, they extend so as to approach the free end of the web 937-1 at an increasing distance from the axis 805. The scraping stroke 906 thus results in this instance in that the bending lines 960 do not run parallel to the axis 805, while the edge 974 itself runs parallel to the bending line 960, as can also be seen from FIG. 66. It is also clear here that a very sharp scraping edge 974 is formed by the angling of this bend at the bending line 960, since the end face 903 is substantially at a right angle relative to the side surface 904, the latter forming an edge 974 between them which rests on the aperture rim of the chord-shaped area 31 in such a way that the surface 903 and 904, respectively, at both sides of this edge extends out at approximately 45° and the full sharpness of the edge 974 is accordingly effective. In FIG. 64, on the other hand, the corresponding area lies substantially flatter than 45° because the surface 904 is pressed flat, so that the sharpness is no longer fully effective in this case. To this extent, the embodiment form according to FIGS. 65 to 67 is provided with an even greater scraping effect. It should be added that the depression 954-1 assigned to the spring 937 can advisably have a flat surface area in this instance in contrast to the depression 854-1, wherein the depth 907 of this depression is selected in such a way that it is capable of receiving the area 902 of the leg 937-1, including the bends 990 (in that these bends are bent back if necessary), while the upper end of the depression 954-1, starting at the bending line 903, becomes increasingly flatter and is adapted to the contour of the area 901 of the leg 937-1 so as only to have a depth at the upper end such that the material thickness 908 of the leg 937-1 is just received. If the length of the leg 937-1 is selected in such a way that it just reaches as far as the flange 30 of the housing, the end 908 of the leg contacts the last scraped area 803 of the aperture 29 in a springing manner (and so as to be substantially received in the offset 954-1) and accordingly maintains the desired grounding contact.

The embodiment form according to FIG. 66 has the further advantage that a self-clamping of the spring on the housing is made possible by the diagonally offset area for the spring part 901 inside the depressions 954-1, so that the spring can be fastened on the housing in this way after being mounted.

Figure 69A:
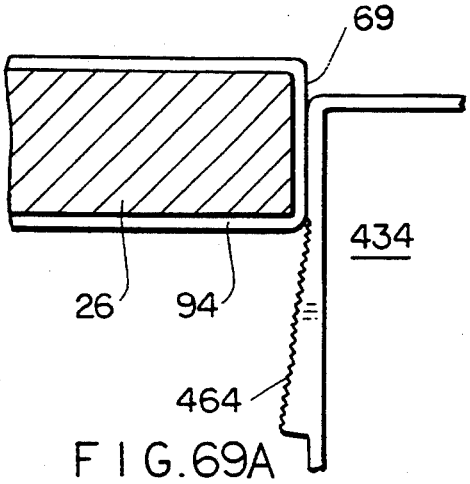
Figure 69B:
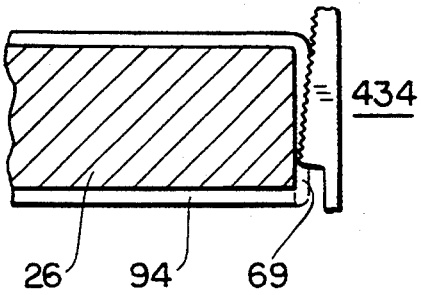
Figure 69D:
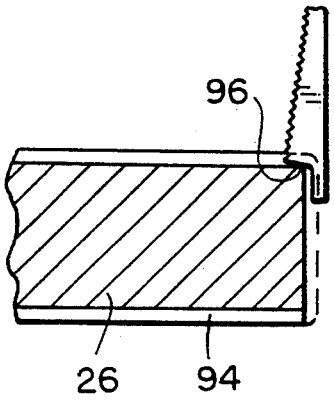
Figure 69C:
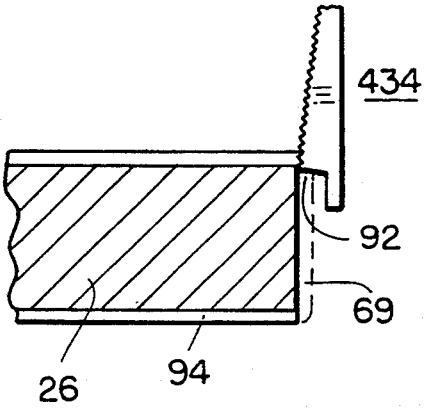

FIGS. 68A, 68B and 69A to 69D show in a schematic manner how the bends 90 of the embodiment form of FIGS. 24 to 29 can likewise be provided with a toothing 464 and how, when the housing 411 provided with the spring 434 is inserted, this toothing scrapes off (FIGS. 69A, 69B and 69C) a lacquer or oxide layer 94 located on the surface of the material of the door leaf or the like, 26, and is then supported on the corner areas 96 of the aperture by the front edge 92, see FIG. 69D.

INDUSTRIAL APPLICATION

The lock housing and locks of the described type are used e.g. in the electrical industry for locking switch cabinets manufactured from sheet metal.

I claim:

1. A lock housing comprising:

a flange;

a hollow body for receiving a lock, said hollow body having a lateral wall and a longitudinal axis, said lateral wall including an external surface and a recess in said external surface, said body being connected to said flange at one end and adapted to be inserted into a hole in a wall; and spring means for mounting said housing in the hole, said spring means comprising:

a fixed end;

a free end;

an outermost surface;

a first end; and, an engaging surface;

said fixed end being fixed to said housing and substantially parallel to the longitudinal axis, said free end being substantially parallel to said fixed end, said first end being substantially perpendicular to said fixed and free ends, and said engaging surface being substantially parallel to said first end and positioned nearer to said flange than said first end;

said engaging surface engaging the wall when said housing is fully inserted;

said spring means occupying a range of positions between a compressed position and a non-compressed position, said compressed position occurring when said spring means is entirely received by the recess in said external surface and said outermost surface does not protrude from said external surface and said non-compressed position occurring when said outermost surface protrudes from said external surface, said spring means occupying said compressed position during insertion of said hollow body into the hole and occupying said non-compressed position when fully inserted to bias said flange against the wall.

2. The lock housing of claim 1, wherein said spring means further comprises a first outer width at said first end and a second outer width at said engaging surface, wherein said second outer width is greater than said first outer width while said spring means occupies a position other than said compressed position.

3. The lock housing of claim 1, wherein said spring means further comprises a first thickness at said first end and a second thickness at said engaging surface, said second thickness being greater than said first thickness.

* * * * *